US008121316B2

(12) United States Patent
Dodd

(10) Patent No.: US 8,121,316 B2
(45) Date of Patent: Feb. 21, 2012

(54) PHASE PLUG

(75) Inventor: Mark Dodd, Woodbridge (GB)

(73) Assignee: GP Acoustics (UK) Limited, Kent (GB)

( * ) Notice: Subject to any disclaimer, the term of this patent is extended or adjusted under 35 U.S.C. 154(b) by 540 days.

(21) Appl. No.: 12/297,186

(22) PCT Filed: Apr. 13, 2007

(86) PCT No.: PCT/GB2007/001375

§ 371 (c)(1),
(2), (4) Date: Mar. 5, 2009

(87) PCT Pub. No.: WO2007/122386

PCT Pub. Date: Nov. 1, 2007

(65) Prior Publication Data

US 2010/0290658 A1 Nov. 18, 2010

(30) Foreign Application Priority Data

Apr. 13, 2006 (GB) ..... 0607454.6

(51) Int. Cl.
*H04R 25/00* (2006.01)
*H04R 1/20* (2006.01)

(52) U.S. Cl. ..... 381/186; 381/342; 381/343

(58) Field of Classification Search ..... 381/182, 381/186, 342–343, 401–402
See application file for complete search history.

(56) References Cited

U.S. PATENT DOCUMENTS 4,050,541 A 9/1977 Henricksen
4,143,738 A 3/1979 Nakazono et al.
4,157,741 A 6/1979 Goldwater
4,628,155 A 12/1986 Robineau et al.
5,117,462 A 5/1992 Bie
5,548,657 A 8/1996 Fincham
5,742,696 A * 4/1998 Walton ..... 381/340
5,778,084 A 7/1998 Kling et al.
6,094,495 A 7/2000 Rocha (Continued)

FOREIGN PATENT DOCUMENTS

GB 654378 A 6/1951

(Continued)

OTHER PUBLICATIONS

Bob H. Smith, "An Investigation of the Air Chamber of Horn Type Loudspeakers," The Journal of the Acoustical Society of America, vol. 25, No. 2, Mar. 1953, pp. 305-312.

(Continued)

*Primary Examiner* — Ramon Barrera

(74) *Attorney, Agent, or Firm* — Kenneth L. Sherman, Esq.; Michael Zarrabian, Esq.; Myers Andras Sherman & Zarrabian LLP

(57) ABSTRACT

A phase plug comprises a body having an input side for receiving acoustic waves and an output side for transmitting acoustic waves, the body including a plurality of channels extending from the input side to the output side for propagating acoustic waves through the body. The input side comprises an input surface which includes a plurality of slots constituting entrances for the channels, each slot being arranged in a substantially radial orientation on the input surface about a central axis extending through the input surface. Substantially the entire input surface situated between the slots is concave and substantially part of a sphere or an ellipsoid in shape.

16 Claims, 3 Drawing Sheets

U.S. PATENT DOCUMENTS

| | | | |
|---|---|---|---|
| 2003/0215107 | A1 | 11/2003 | Werner |
| 2004/0156519 | A1 | 8/2004 | Geddes |
| 2005/0105753 | A1 | 5/2005 | Manzini et al. |
| 2009/0304218 | A1 | 12/2009 | Dodd et al. |

FOREIGN PATENT DOCUMENTS

| | | | |
|---|---|---|---|
| JP | 5510217 | A | 1/1980 |
| JP | 04033499 | A | 2/1992 |

OTHER PUBLICATIONS

United Kingdom Intellectual Property Office Search Report, UK Patent Application No. GB0607454.6, Jul. 12, 2006, 1 page.

International Search Report of International Application No. PCT/GB2007/001379, Jul. 8, 2007, 2 pages.

Written Opinion of International Application No. PCT/GB2007/001379, Jul. 8, 2008, 7 pages.

Notification of Transmittal of the International Search Report and the Written Opinion of the International Searching Authority, International Application No. PCT/GB2007/001375, dated Jul. 8, 2007.

United Kingdom Intellectual Property Office Search Report, UK patent application GB0607454.6, dated Jul. 12, 2006, 3 pages.

Search Report of United Kingdom Intellectual Property Office dated Jul. 12, 2006 for the United Kingdom Patent Application No. GB0607452.0, pp. 1-2, Newport, South Wales, United Kingdom.

* cited by examiner

PHASE PLUG

CROSS REFERENCE TO RELATED APPLICATIONS

This application is a national stage application under 35 U.S.C. 371 of PCT/GB2007/001375 filed Apr. 13, 2007, which claims priority of GB 0607454.6 filed Apr. 13, 2006. Both applications PCT/GB2007/001375 and GB 0607454.6, which are incorporated herein by reference in their entirety.

The present invention relates to loudspeakers, and particularly relates to compression drivers and to phase plugs for compression drivers.

A compression driver is a type of loudspeaker in which an acoustically radiating diaphragm radiates acoustic waves into a small cavity. The cavity is connected by a phase plug (also known as a phase adaptor, a phase transformer, an acoustic transformer, etc.) to an aperture, which normally opens into a horn waveguide. The small cavity and throat area present the diaphragm with a high acoustic load, and because of this, it tends to be highly efficient. However, the cavity in front of the diaphragm can cause acoustic problems at high frequencies. In particular, the cavity can exhibit strong resonances (known as cavity modes) at distinct frequencies that are commonly within the working band of the compression driver. These resonances can undesirably introduce large pressure response variations in the output of the compression driver. Additionally, the high pressure levels in the cavity that occur when the resonances are excited are undesirable for driver linearity. The severity of the resonance problem is determined primarily by the shape of the cavity, the design of the phase plug and, more specifically, the location and size of the pathways (channels) through the phase plug.

The present invention seeks to provide a phase plug that, among other things, enables improved suppression of cavity mode resonances.

Accordingly, a first aspect of the present invention provides a phase plug, comprising a body having an input side for receiving acoustic waves and an output side for transmitting acoustic waves, the body including a plurality of channels extending from the input side to the output side for propagating acoustic waves through the body, wherein the input side comprises an input surface which includes a plurality of slots constituting entrances for the channels, each slot being arranged in a substantially radial orientation on the input surface about a central axis extending through the input surface, wherein substantially the entire input surface situated between the slots is concave and substantially part of a sphere or an ellipsoid in shape.

In preferred embodiments of the invention, at least one of the slots, preferably each slot, has a varying width along at least half of its length (its length being in the radial direction, and termed the "radially extending length" herein). Most preferably, each slot has a varying width along substantially its entire radially extending length. Advantageously, the slot width may increase in a radial direction extending away from the central axis of the phase plug. The slots preferably are joined to each other via an opening at an axially central region of the input surface of the phase plug. The opening preferably is an entrance for an axially central channel extending from the input side to the output side of the body of the phase plug.

Each channel extending through the phase plug body preferably increases in width (i.e. widens out) in a direction extending from its entrance slot towards the output side of the phase plug body.

The phase plug preferably includes a plurality of spaced apart fins which at least partly define the channels extending through the body of the phase plug. Each fin may, for example, become narrower in width in a direction extending from the input surface towards the output side of the phase plug body; in this way the channels defined by the fins become wider in the same direction. The fins are advantageously arranged in substantially radial orientations about the central axis, for example by each fin projecting towards the central axis from an outer circumferential part of the phase plug. The circumferential part preferably has a generally frusto-conical shape, with a smallest radius adjacent to the input side of the phase plug and a largest radius adjacent to the output side of the phase plug.

A second aspect of the invention provides a phase plug, comprising a body having an input side for receiving acoustic waves and an output side for transmitting acoustic waves, the body including a plurality of channels extending from the input side to the output side for propagating acoustic waves through the body, wherein the input side comprises a concave input surface which includes a plurality of slots constituting entrances for the channels, each slot being arranged in a substantially radial orientation on the input surface about a central axis extending through the input surface, wherein at least one of the slots has a varying width along at least half of its length.

A third aspect of the invention provides a phase plug, comprising a body having an input side for receiving acoustic waves and an output side for transmitting acoustic waves, the body including a plurality of channels extending from the input side to the output side for propagating acoustic waves through the body, wherein the input side comprises a concave input surface which includes a plurality of slots constituting entrances for the channels, each slot being arranged in a substantially radial orientation on the input surface about a central axis extending through the input surface, wherein the slots are joined to each other via an opening at an axially central region of the input surface.

A fourth aspect of the invention provides a compression driver, comprising a phase plug according to the first, second or third aspect of the invention, and an acoustically radiating diaphragm situated adjacent to the input side of the phase plug.

The diaphragm preferably has a convex acoustically radiating surface. For example, the acoustically radiating surface of the diaphragm may be substantially part of a sphere or an ellipsoid in shape. Preferably the acoustically radiating surface of the diaphragm is substantially rigid.

The compression driver may advantageously include a horn waveguide situated adjacent to the output side of the phase plug. In at least some embodiments of the invention, the horn waveguide is non-circular in cross-section perpendicular to the central axis. For example, the horn may be oval in cross-section, or indeed substantially any shape. However, for many embodiments of the invention, the horn waveguide is substantially circular in cross-section perpendicular to the central axis.

The horn waveguide may be substantially frusto-conical (i.e. the horn waveguide may be substantially conical but truncated at the throat of the horn). However, the horn waveguide may be flared, e.g. flared such that it follows a substantially exponential curve, or a substantially parabolic curve, or another flared curve. Other horn waveguide shapes are also possible.

The horn waveguide may be a static waveguide, or it may itself be an acoustically radiating diaphragm, e.g. a cone diaphragm. Consequently, in some embodiments of the invention, the horn waveguide may comprise a driven acoustically radiating diaphragm. The horn diaphragm may be driven substantially independently of the dome-shaped diaphragm, for example such that the horn diaphragm is arranged to radiate acoustic waves of generally lower frequency than is the dome-shaped diaphragm. Consequently, the loudspeaker may include a drive unit to drive the horn diaphragm. An example of a suitable arrangement (but without a phase plug according to the present invention) in which the horn waveguide itself comprises an acoustically radiating diaphragm, is disclosed in U.S. Pat. No. 5,548,657.

A fifth aspect of the invention provides a combination loudspeaker, comprising an acoustically radiating horn diaphragm, a driver for the horn diaphragm, and a compression driver according to the fourth aspect of the invention located in, or adjacent to, a throat of the horn diaphragm. Preferably the compression driver is arranged to radiate high frequency sounds, and the horn diaphragm preferably is arranged to radiate low or mid-range frequency sounds.

The acoustically radiating horn diaphragm of the combination loudspeaker may comprise the horn waveguide of the compression driver.

It is to be understood that any feature of any aspect of the invention may be a feature of any other aspect of the invention.

The phase plug preferably is formed from one or more of: a metal or metal alloy material; a composite material; a plastics material; a ceramic material.

The diaphragm of the compression driver preferably is formed from a substantially rigid low density material, for example one or more of: a metal or metal alloy material; a composite material; a plastics material; a ceramic material. Some preferred metals for forming a suitable metal or metal alloy material include: titanium; aluminium; and beryllium. The acoustically radiating surface of the diaphragm of the compression driver may be formed from a specialist material, for example diamond (especially chemically deposited diamond).

The horn waveguide may be formed from any suitable material, for example one or more of: a metal or metal alloy material; a composite material; a plastics material; a fabric material; a ceramic material. For those embodiments of the invention in which the horn waveguide is an acoustically radiating diaphragm, it preferably is formed from a plastics material or a fabric material, for example. Metal and/or paper may be preferable in some cases.

A preferred embodiment of the invention will now be described, by way of example, with reference to the accompanying drawings, of which:

Figure 1:
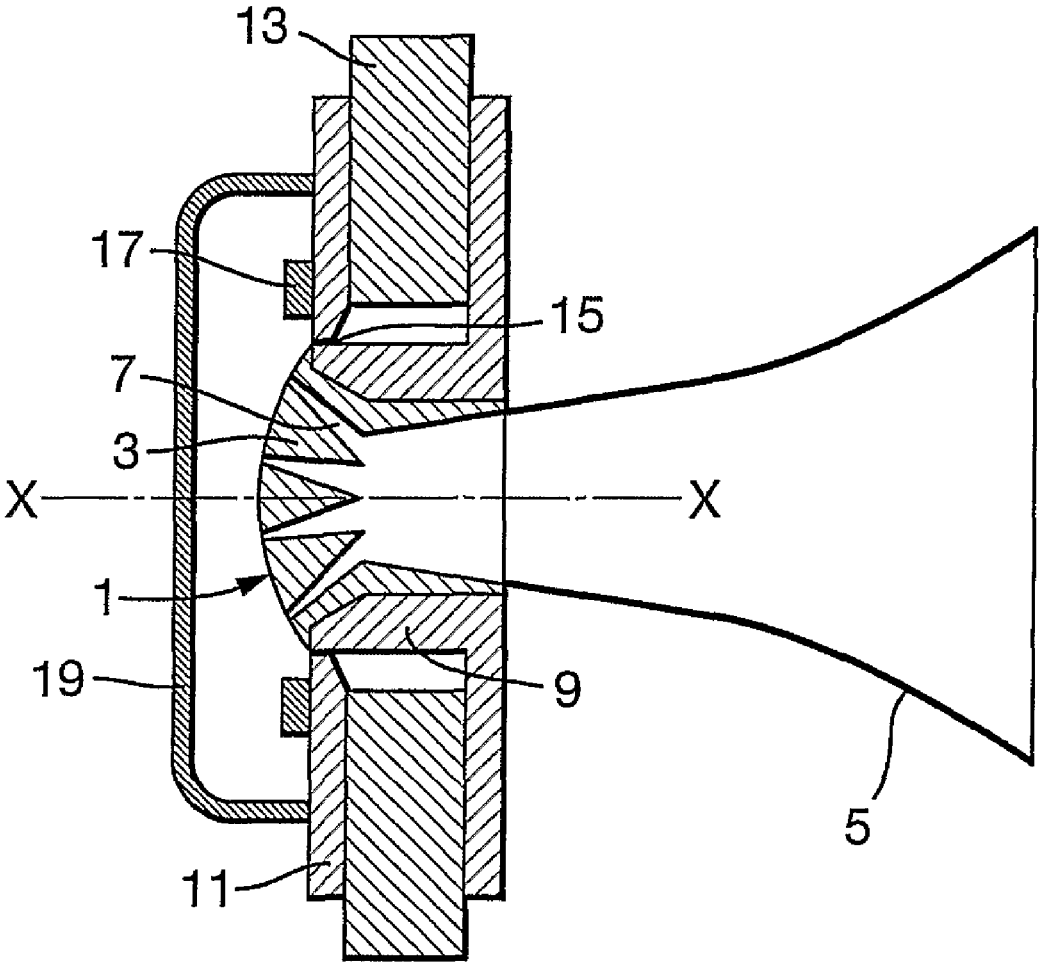
FIG. 1 is a cross-sectional schematic representation or a known conventional compression driver.
Figure 2A:
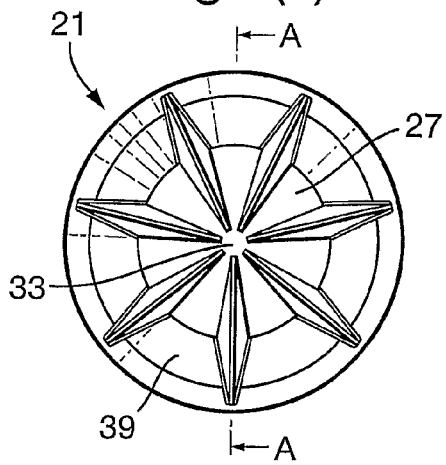
FIG. 2 shows six views ((a) to (f)) of an embodiment of a phase plug according to the invention.
Figure 2B:
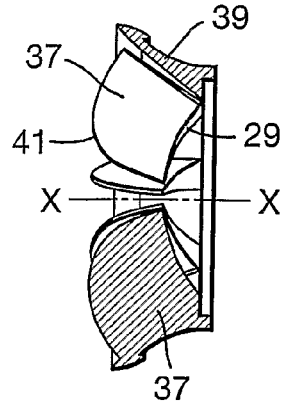
Figure 2C:
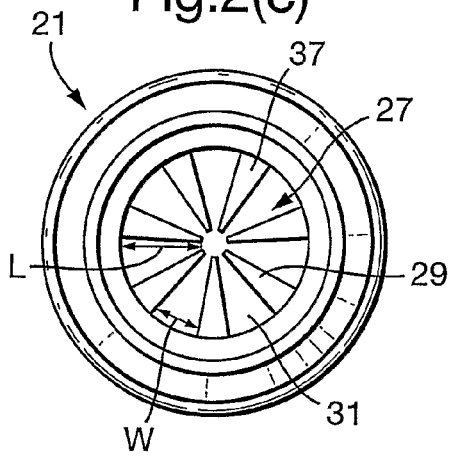
Figure 2D:
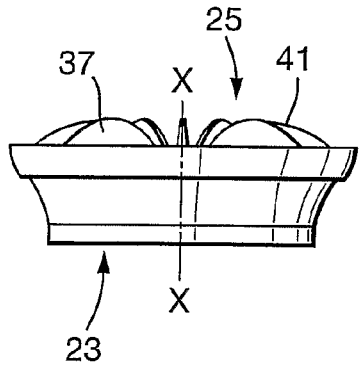
Figure 2E:
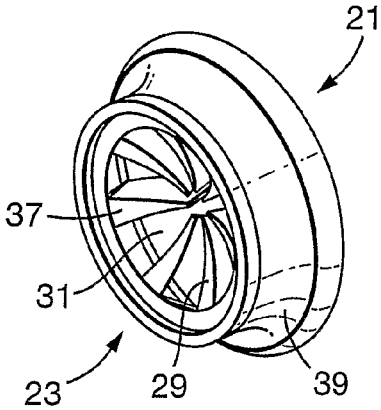
Figure 2F:
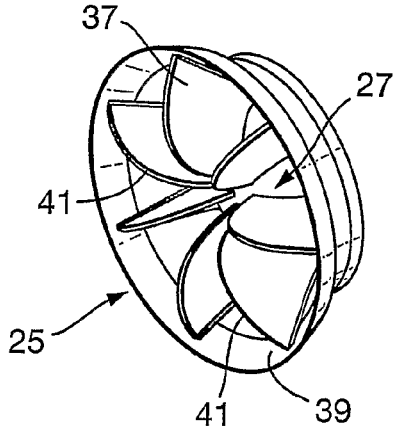

FIG. 1 is a cross-sectional schematic representation of a known conventional compression driver. The compression driver comprises an acoustically radiating diaphragm 1 having a concave acoustically radiating surface situated adjacent to an input side of a phase plug 3. On an opposite (output) side of the phase plug 3 is a horn waveguide 5. The diaphragm 1, phase plug 3, and horn waveguide 5 have a central axis X-X extending therethrough. The diaphragm 1, phase plug 3, and horn waveguide 5 are arranged such that acoustic waves generated by the diaphragm 1 are propagated through annular channels 7 extending through the phase plug 3 from the input side to the output side of the phase plug and are then received and propagated by the horn waveguide 5. The diaphragm 1 is driven by means of a driver assembly comprising a centre pole part 9, an outer pole part 11, and a magnet 13. Specifically, an annular skirt portion of the diaphragm 1, which projects from the circumference of the acoustically radiating surface, carries an electrically conductive coil, and the coil and skirt portion of the diaphragm are situated in a gap 15 between the centre pole part 9 and the outer pole part 11, which gap has a magnetic field extending across it. A clamp ring 17 and a rear enclosure part 19 are also shown.

FIG. 2 shows six views ((a) to (f)) of an embodiment of a phase plug 21 according to the invention. The phase plug 21 of FIG. 2 comprises a body having an input side 23 for receiving acoustic waves and an output side 25 for transmitting acoustic waves. A plurality of channels 27 extends from the input side 23 to the output side 25 for propagating acoustic waves through the body of the phase plug 21. The input side 23 comprises a concave input surface 29 which includes a plurality of openings 31 in the form of slots, which constitute entrances for the channels 27. The input surface is substantially part of a sphere (or an ellipsoid, but preferably a sphere) in shape. The slots 31 are arranged in a substantially radial orientation on the input surface 29 about the central axis X-X. In the embodiment illustrated in FIG. 2, the phase plug 3 includes seven channels, and thus seven slots, but fewer or a greater number of slots may be used instead. Each channel 27 (and thus also each slot 31, which is an entrance of a channel) is partially defined, and separated from neighbouring channels 27, by a pair of spaced apart fins 37. Because there are seven channels there are also seven radially arranged spaced-apart fins 37. Each fin projects towards the central axis X-X from an outer circumferential part 39 of the phase plug 21. The circumferential part 39 has a generally frusto-conical shape, with its smallest radius adjacent to the input side 23 and its largest radius adjacent to the output side 25.

The widths of the slots 31 vary with radial position on the input surface 29 of the phase plug 21 illustrated in FIG. 2. More particularly, the widths of the slots 31 increase with radial distance from the central axis X-X. An axially central opening 33 of an axially central channel extending through the phase plug 21 joins all of the slots 31 to each other. The width W and length L dimensions of the slots are indicated in view (c) of FIG. 2.

Each channel 27 widens in an approximately exponential manner in a direction parallel to the central axis X-X from the input side 23 to the output side 25 of the phase plug 21. This is because each fin 37 decreases in width from the input side 23 to the output side 25 of the phase plug 21. As shown in view (f) of FIG. 2, the output edge 41 of each fin 37 has a thin substantially constant width. Additionally, the output edge 41 of each fin 37 curves substantially continuously from the circumferential part 39 at the output side 25 of the phase plug 21, to the radially innermost part of the fin at the input surface 29.

Figure 3:
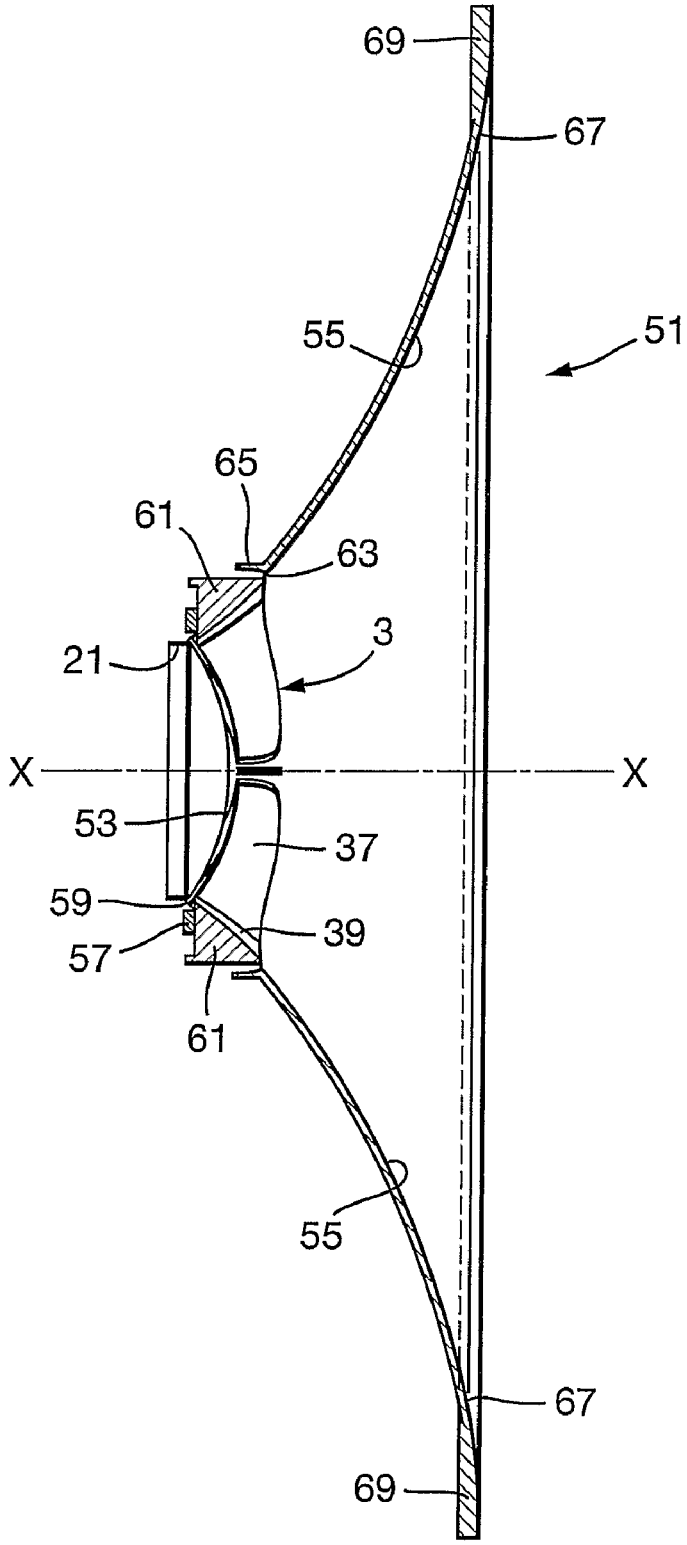
FIG. 3 is a schematic cross-sectional representation of a combination loudspeaker according to the invention, comprising a convex radiating diaphragm, a phase plug of the type illustrated in FIG. 2, and a radiating horn diaphragm.

FIG. 3 is a schematic cross-sectional representation of a combination loudspeaker 51 according to the invention, comprising a convex dome-shaped radiating diaphragm 53, a phase plug 3 of the type illustrated in FIG. 2, and a radiating horn diaphragm 55. The convex radiating diaphragm 53 and the phase plug 3 are located in the throat of the horn diaphragm 55. The convex radiating diaphragm 53 is arranged to radiate high frequency sounds, and the horn diaphragm 55 is arranged to radiate low or mid-range frequency sounds. The combination loudspeaker 51 includes a "surround" 57 in the throat of the horn diaphragm 55 that supports the convex radiating diaphragm 53 via a flexible annular web 59, and attached to this surround 57 is a support 61 for the phase plug 3. An inner cylindrical part 65 of the horn diaphragm 55 carries a conductive coil of a driver for the horn diaphragm, which extends into a magnetic gap of the driver (not shown). The horn diaphragm 55 is supported by a second flexible annular web 67 at its outer periphery, and the outer periphery of the second flexible annular web 67 is attached to an outer support 69.

It will be understood that other embodiments of the invention, and modifications of the described and illustrated embodiments of the invention, are possible within the definitions of the invention provided in the appended claims.

The invention claimed is:

1. A combination loudspeaker, comprising:

an acoustically radiating convex diaphragm;

a diverging acoustically radiating horn diaphragm; and a phase plug comprising a body having an input side for receiving acoustic waves from the convex diaphragm and an output side for transmitting acoustic waves into the region within the horn diaphragm, the body including a plurality of channels extending from the input side to the output side for propagating acoustic waves through the body, wherein the input side comprises an input surface which includes a plurality of slots constituting entrances for the channels, each slot being arranged in a substantially radial orientation on the input surface about a central axis extending through the input surface, wherein substantially the entire input surface situated between the slots is concave and substantially part of a sphere or an ellipsoid in shape.

2. A combination loudspeaker according to claim 1, in which at least one of the slots has a varying width along at least half of its radially extending length.

3. A combination loudspeaker according to claim 2, in which each slot has a varying width along at least half of its radially extending length.

4. A combination loudspeaker according to claim 3, in which each slot has a varying width along substantially its entire radially extending length.

5. A combination loudspeaker according to claim 4, in which the slots are joined to each other via an opening at an axially central region of the input surface, the opening being an entrance for an axially central channel extending from the input side to the output side of the body of the phase plug.

6. A combination loudspeaker according to claim 3, in which each slot has an increasing width along substantially its entire radially extending length.

7. A combination loudspeaker according to claim 1, in which each channel increases in width in a direction extending from its entrance slot towards the output side of the phase plug body.

8. A combination loudspeaker according to claim 1, also comprising a plurality of spaced apart fins which at least partly define the channels extending through the body of the phase plug.

9. A combination loudspeaker according to claim 8, in which the fins are arranged in substantially radial orientations about the central axis.

10. A combination loudspeaker according to claim 8, in which each fin narrows in width in a direction extending from the input surface towards the output side of the phase plug body.

11. A combination loudspeaker according to claim 8, in which each fin projects towards the central axis from an outer circumferential part of the phase plug.

12. A combination loudspeaker according to claim 11, in which the circumferential part has a generally frusto-conical shape, with a smallest radius adjacent to the input side and a largest radius adjacent to the output side.

13. A combination loudspeaker according to claim 1, in which the acoustically radiating surface of the convex diaphragm is substantially rigid and part of a sphere or an ellipsoid in shape.

14. A combination loudspeaker according to claim 1, wherein:

the input side of the body of the phase plug is proximal to a dome of the convex diaphragm; and the output side of the body of the phase plug is proximal to a throat of a conical region of the horn diaphragm;

wherein the phase plug is positioned between the dome of the convex diaphragm and said throat of the horn diaphragm about said central axis that extends through the convex diaphragm, the phase plug and the horn diaphragm.

15. A combination loudspeaker, comprising:

an acoustically radiating convex diaphragm;

a diverging acoustically radiating horn diaphragm; and a phase plug comprising a body having an input side for receiving acoustic waves from the convex diaphragm and an output side for transmitting acoustic waves into the region within the horn diaphragm, the body including a plurality of channels extending from the input side to the output side for propagating acoustic waves through the body, wherein the input side comprises a concave input surface which includes a plurality of slots constituting entrances for the channels, each slot being arranged in a substantially radial orientation on the input surface about a central axis extending through the input surface, wherein at least one of the slots has a varying width along at least half of its radially extending length.

16. A phase plug suitable for a combination loudspeaker having an acoustically radiating convex diaphragm and a diverging acoustically radiating horn diaphragm, comprising a body having an input side for receiving acoustic waves from the convex diaphragm and an output side for transmitting acoustic waves into the region within the horn diaphragm, the body including a plurality of channels extending from the input side to the output side for propagating acoustic waves through the body, wherein the input side comprises a concave input surface which includes a plurality of slots constituting entrances for the channels, each slot being arranged in a substantially radial orientation on the input surface about a central axis extending through the input surface, wherein the slots are joined to each other via an opening at an axially central region of the input surface.

* * * * *